US006959579B2

(12) United States Patent
Titus

(10) Patent No.: US 6,959,579 B2
(45) Date of Patent: Nov. 1, 2005

(54) TRIPLE BEARING ARRANGEMENT FOR CANTILEVERED ROLL SHAFTS

(75) Inventor: David G. Titus, West Boylston, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 10/828,945

(22) Filed: Apr. 21, 2004

(65) Prior Publication Data

US 2004/0221637 A1 Nov. 11, 2004

Related U.S. Application Data

(60) Provisional application No. 60/468,807, filed on May 8, 2003.

(51) Int. Cl.[7] ..... B21B 31/02; B21B 31/26

(52) U.S. Cl. ..... 72/237; 72/248

(58) Field of Search ..... 72/237, 248, 249

(56) References Cited

U.S. PATENT DOCUMENTS

| | | | | |
|---|---|---|---|---|
| 2,106,866 A | * | 2/1938 | Best | 72/31.08 |
| 3,190,098 A | * | 6/1965 | Wilson | 72/223 |
| 3,491,571 A | * | 1/1970 | O'Brien | 72/244 |
| 4,036,030 A | | 7/1977 | Papst | |
| 4,772,137 A | | 9/1988 | Salter, Jr. et al. | |
| 6,561,003 B2 | | 5/2003 | Grimmel | |

* cited by examiner

*Primary Examiner*—Lowell A. Larson
(74) *Attorney, Agent, or Firm*—Gauthier & Connors, LLP

(57) ABSTRACT

A rolling mill roll stand comprises parallel roll shafts rotatably supported by axially spaced first and second bearings contained in parallel eccentric sleeves. The eccentric sleeves are rotatably supported in a housing and the roll shafts have cantilevered ends that project externally from one side of the housing and that are adapted to carry work rolls. Third oil film bearings are contained by the eccentric sleeves and are arranged to rotatably support the roll shafts at intermediate locations between and spaced axially from both the first and second bearings.

5 Claims, 2 Drawing Sheets

TRIPLE BEARING ARRANGEMENT FOR CANTILEVERED ROLL SHAFTS

CROSS REFERENCE TO RELATED APPLICATION

This application claims priority from Provisional Application Ser. No. 60/468,807 filed May 8, 2003.

BACKGROUND OF THE INVENTION

1. Field of the Invention

This invention relates generally to rolling mills for rolling long products, e.g., rods, bars and the like, and is concerned in particular with an improvement to the so-called "cantilevered" roll stands, where the work rolls are mounted on the distal ends of support shafts.

2. Description of the Prior Art

Cantilevered work rolls are conventionally mounted on the distal ends of parallel support shafts. The shafts are journalled for rotation in axially spaced work and drive side bearings contained in eccentric sleeves, the latter in turn being mounted for rotatable adjustment in a cartridge housing. The roll shafts carry gears arranged to mesh with gears of the mill drive, and by simultaneously rotating the eccentric sleeves in opposite directions, symmetrical adjustments are imparted to the work rolls with respect to the mill pass line.

A more detailed description of this conventional arrangement can be had by reference to U.S. Pat. No. Re 28,107, the disclosure of which is herein incorporated by reference.

With the advent of smaller diameter work rolls, roll shaft diameters are also of necessity decreased, resulting in shaft lengths being excessively long in comparison to their diameters. Although the conventional two bearing arrangement can satisfy strength requirements reasonable well, the same is not true for stiffness, and shaft deflection becomes a problem.

One attempt at solving this problem is disclosed in U.S. Pat. No. 6,561,003 (Grimmel). Here, pressure sleeves are employed between the conventional work and drive side bearings. The pressure sleeves are hydrostatically loaded and controlled remotely to preload the shafts and thereby counteract their tendency to deflect under load. In addition to being unduly complex and expensive, this arrangement suffers from a lack of rigidity in that the roll shafts are merely contained by the pressure sleeves, with the latter lacking critical radial support from the surrounding cartridge housing.

SUMMARY OF THE INVENTION

In accordance with the present invention, additional shaft rigidity is supplied by providing third bearings between the conventional work and drive side bearings. The third bearings are of the "oil film" type, in which the shafts are journalled for rotation on films of oil maintained hydronamically at the bearing load zones. The oil film bearings have self modulating stiffnesses that increase in direct proportion to bearing eccentricity, without the need for separately controlled hydrostatic introduction of pressurized oil. In addition, the third bearings are radially supported by both the eccentric sleeves and the cartridge housing, thus providing increased rigidity as compared to known prior art arrangements.

These and other features and advantages of the present invention will now be described in greater detail with reference to the accompanying drawings, wherein:

DETAILED DESCRIPTION OF PREFERRED EMBODIMENT

Figure 1:
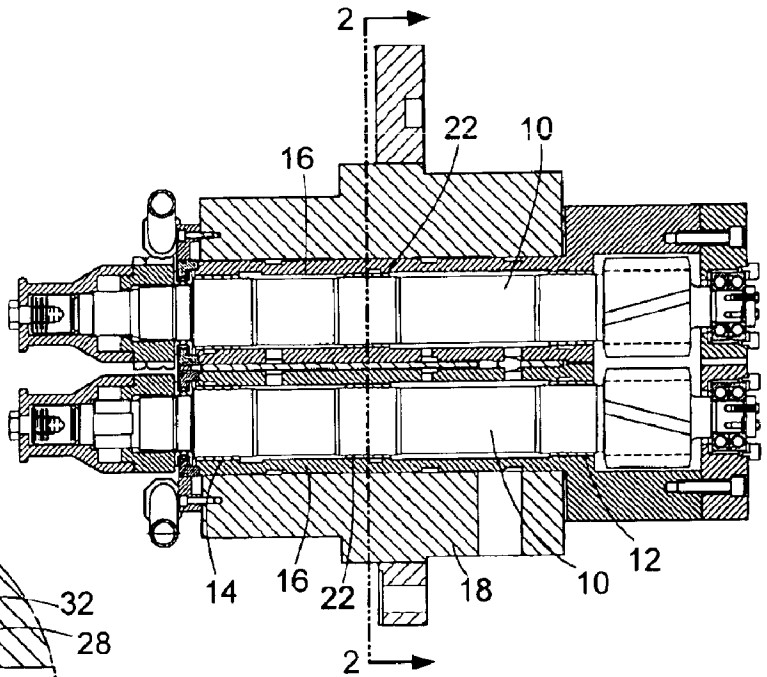
FIG. 1 is a longitudinal sectional view taken through a cantilevered roll stand embodying the concept of the present invention.
Figure 2:
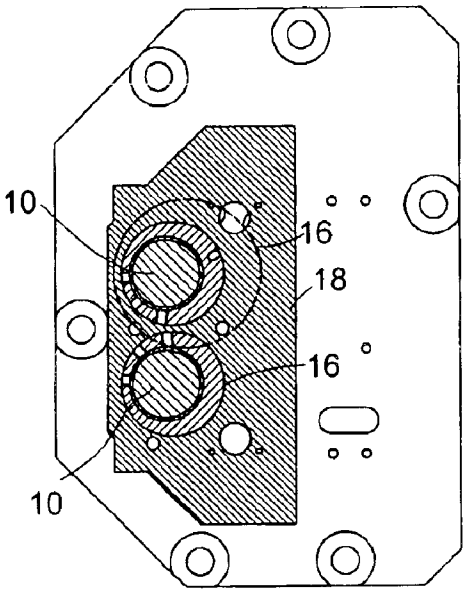
FIG. 2 is a cross sectional view taken along line 2—2 of FIG. 1.

Referring initially to FIGS. 1 and 2, roll shafts 10 are rotatably supported by drive and work side sleeve bearings 12, 14 contained in eccentric sleeves 16. The eccentric sleeves are journalled for rotation and rotatably adjustable within a cartridge housing 18. The cantilevered outboard ends 10*a* of the roll shafts are configured to support work rolls (not shown), and the cantilevered inboard ends carry gears 20 configured and arranged to mesh with drive gears (not shown) of the mill drive.

The midsections of the roll shafts are journalled for rotation in third bearings 22 contained within midsections of the eccentric sleeves 16, with the midsections of the eccentric sleeves being tightly contained within and thus robustly backed by the cartridge housing. The bearings 22 are of the sleeve-type, lubricated by oil, with shaft rotation creating a hydrodynamic film of oil at the load zones of the bearings.

Figure 3:
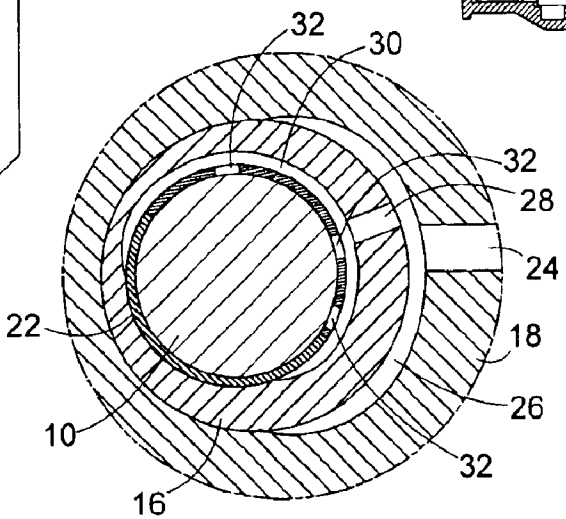
FIG. 3 is an enlarged view of a portion of FIG. 2.

More particularly, and as can best be seen in FIG. 3, the cartridge housing 18 is provided with an inlet passageway 24 communicating with an arcuate groove 26 in the bore containing the eccentric sleeve 16. A radial passageway 28 leads from the groove 26 to a second arcuate of groove 30 in the bore of the eccentric sleeve. The sleeve bearing 22 has radial passageways 32 communicating with the groove 30.

During operation of the roll stand, oil is supplied via passageway 24, groove 26, passageway 28, groove 30 and passageways 32 to the operating clearance between the journal surface of shaft 10 and the interior bearing surface of sleeve 22. The oil is hydrodynamically formed into a wedge-shaped film at the loaded zone of the bearing.

Figure 4:
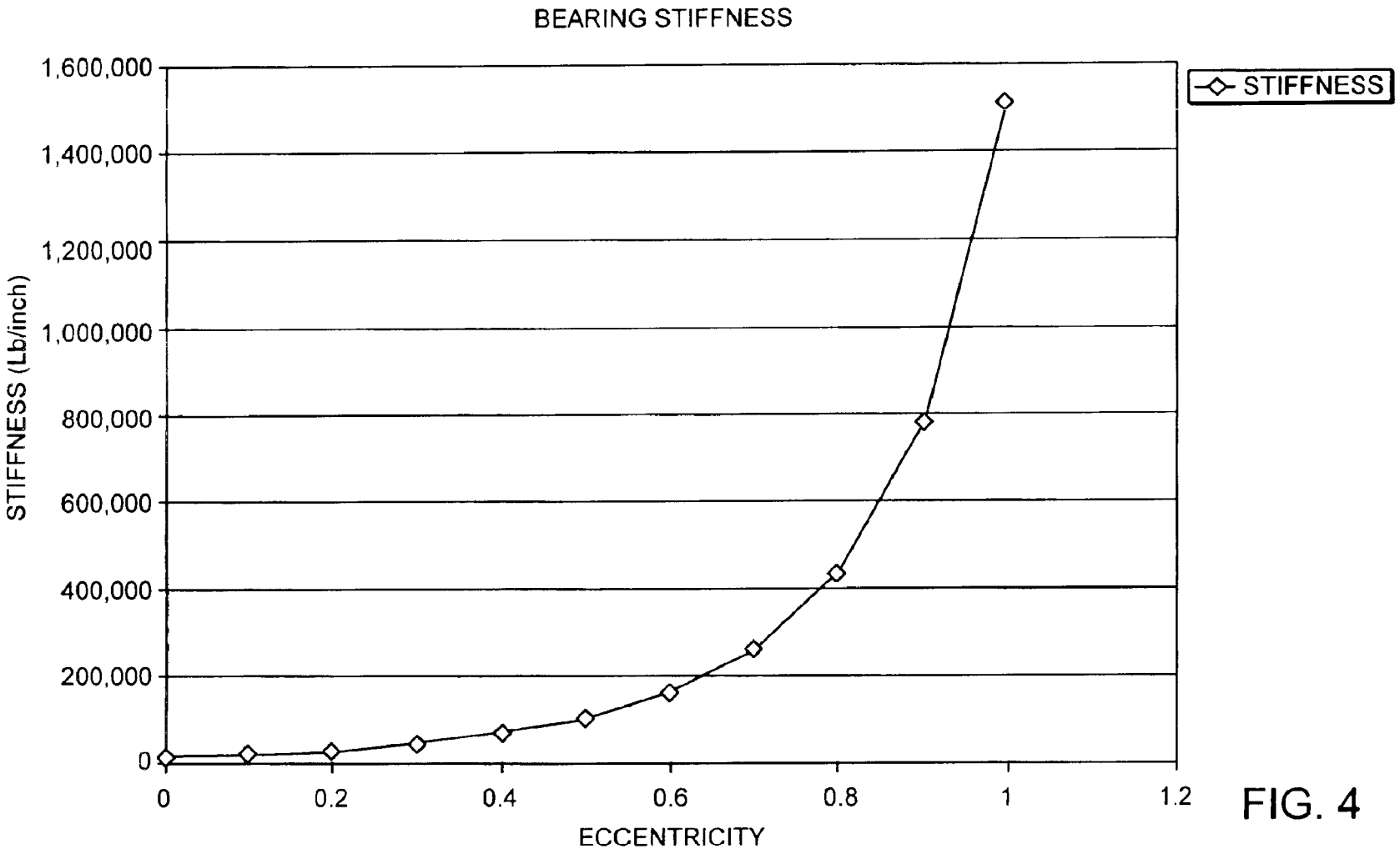
FIG. 4 is a graph depicting how the stiffness of the third oil film bearings increases in direct proportion to bearing eccentricity.

As the roll shafts undergo loading due to separating forces being exerted on the cantilevered work rolls, shaft deflection will be resisted by the bearings 22. As the roll shafts tend to deflect under loads, FIG. 4 illustrates how the stiffness of the bearings 22 increases hydrodynamically in response to increased eccentricity of the shaft journal surfaces within the bearings. The increase in bearing stiffness is self modulating, requiring no separate application of pressurized oil and no remote control.

The eccentric sleeves 16 are of a robust design, with mid sections that extend continuously between the drive and work side bearings. This, in combination with the backing of the eccentric sleeve midsections by the cartridge housing and the self modulating counter forces being developed by the bearings 22, all contribute to significantly increase the overall stiffness of the roll package.

I claim:

1. A rolling mill roll stand comprising:

parallel roll shafts rotatably supported by axially spaced first and second bearings;

parallel eccentric sleeves containing said bearings, said eccentric sleeves being rotatably supported in a housing, said roll shafts having cantilevered ends that project externally from one side said housing and that are adapted to carry work rolls; and third bearings contained by said eccentric sleeves, said third bearings being arranged to rotatably support said roll shafts at intermediate locations between and spaced axially from both said first and second bearings, said eccentric sleeves being journalled for rotation within and being radially supported by said housing at said intermediate locations.

2. The roll stand of claim 1 wherein said third bearings are oil film bearings.

3. The roll stand of claim 1 wherein said roll shafts have second cantilevered ends projecting externally from the opposite side of said housing, said second cantilevered ends being adapted to support drive gears.

4. The roll stand of claim 1 wherein said third bearings are oil lubricated sleeve bearings having self modulating stiffnesses that increase in direct proportion to the eccentricity of the shaft journal surfaces within said bearings.

5. A rolling mill roll stand comprising:

parallel roll shafts rotatably supported by axially spaced first and second bearings;

parallel eccentric sleeves containing said bearings, said eccentric sleeves being rotatably supported in a housing, said roll shafts having cantilevered ends that project externally from one side said housing and that are adapted to carry work rolls; and third bearings contained by said eccentric sleeves and arranged to rotatably support said roll shafts at intermediate locations between and spaced axially from both said first and second bearings, said third bearings being oil lubricated sleeve bearings having self modulating stiffnesses that increase in direct proportion to the eccentricity of their respective shaft journal surfaces.

* * * * *